US010011957B2

(12) United States Patent
Woergoetter

(10) Patent No.: US 10,011,957 B2
(45) Date of Patent: Jul. 3, 2018

(54) FALL PREVENTION DEVICE FOR A TRACK-LAYING MACHINE

(71) Applicant: PLASSER & THEURER EXPORT VON BAHNBAUMASCHINEN GESELLSCHAFT M.B.H., Vienna (AT)

(72) Inventor: Herbert Woergoetter, Gallneukirchen (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 128 days.

(21) Appl. No.: 15/033,754

(22) PCT Filed: Nov. 21, 2014

(86) PCT No.: PCT/EP2014/003119
§ 371 (c)(1),
(2) Date: May 2, 2016

(87) PCT Pub. No.: WO2015/090503
PCT Pub. Date: Jun. 25, 2015

(65) Prior Publication Data

US 2016/0265168 A1 Sep. 15, 2016

(30) Foreign Application Priority Data

Dec. 17, 2013 (AT) ..... GM449/2013

(51) Int. Cl.
*E01B 27/00* (2006.01)
*A62B 35/00* (2006.01)
*E01B 37/00* (2006.01)

(52) U.S. Cl.
CPC ..... *E01B 27/00* (2013.01); *A62B 35/0043* (2013.01); *A62B 35/0068* (2013.01); *E01B 37/00* (2013.01); *E01B 2203/00* (2013.01)

(58) Field of Classification Search
CPC ..... E01B 27/00; E01B 37/00; E01B 2203/00; A62B 35/0043; A62B 35/0068; A62B 35/005
See application file for complete search history.

(56) References Cited

U.S. PATENT DOCUMENTS 44,134 A * 9/1864 Worsely ..... B61D 17/17 104/457
2002/0148680 A1* 10/2002 Lee ..... A62B 35/0056 182/3

(Continued)

FOREIGN PATENT DOCUMENTS

WO 2012156417 A1 11/2012

*Primary Examiner* — Jason C Smith
(74) *Attorney, Agent, or Firm* — Laurence A. Greenberg; Werner H. Stemer; Ralph E. Locher

(57) ABSTRACT

A track maintenance machine for carrying out track maintenance operations includes a plurality of mounts disposed at a distance from one another in the longitudinal direction of the machine in an upper end region of the machine relative to a vertical. A lower end of each mount relative to the vertical is mounted on the track maintenance machine, while an upper end of each mount located at a distance from the lower end is connected to a safety line extending in the longitudinal direction of the machine. A method for carrying out service work on track maintenance machines is also provided.

6 Claims, 1 Drawing Sheet

(56) References Cited

U.S. PATENT DOCUMENTS

| | | | | |
|---|---|---|---|---|
| 2014/0202352 | A1* | 7/2014 | Dehmel | B61D 15/00 104/5 |
| 2016/0265168 | A1* | 9/2016 | Woergoetter | A62B 35/0043 |

* cited by examiner

FALL PREVENTION DEVICE FOR A TRACK-LAYING MACHINE

BACKGROUND OF THE INVENTION

Field of the Invention

The invention relates to a track maintenance machine, having a machine frame mobile on on-track undercarriages, for carrying out track maintenance operations, and to a method for carrying out service work, Service work to be performed on track maintenance machines may become dangerous for the working personnel inasmuch as, on the one hand, the machines often are of great overall height and, on the other hand, an operative neighbouring track poses a great danger to a person in the event of stumbling.

BRIEF SUMMARY OF THE INVENTION

It is the object of the present invention to provide a track maintenance machine of the type mentioned at the beginning as well as a method with increased safety for service work.

According to the invention, this object is achieved with a track maintenance machine including a machine frame movable along on-track undercarriages, for carrying out track maintenance operations, and a plurality of mounts spaced from one another in a longitudinal direction of the machine in an upper end region of the track maintenance machine relative to a vertical. Each mount has a lower end, relative to the vertical, fastened to the track maintenance machine, while an upper end, spaced from the lower end, of each mount is connected to a safety line extending in the longitudinal direction of the machine. Further according to the invention, a method for carrying out service work on track maintenance machines includes spacing a safety line apart from the machine frame with regard to a vertical, prior to the start of service work. The safety line extends in the longitudinal direction of the machine or track and is connected via mounts to a machine frame. Subsequently, a worker performing the service work latches himself by a leash, connected to the worker, onto the safety line for free movement in the longitudinal direction of the machine.

With this, the advantageous possibility exists of transferring a safety line relatively quickly into a position transgressing the clearance profile, in which a falling of working personnel can be reliably prevented by clipping on a safety leash. Since a longitudinal mobility of the worker between the adjacent mounts is possible without hindrance, the service work can continue to be performed without limitations.

Additional advantages of the invention become apparent from the dependent claims and the drawing description.

BRIEF DESCRIPTION OF THE SEVERAL VIEWS OF THE DRAWING

The invention will be described in more detail below with reference to embodiments represented in the drawing in which.

DESCRIPTION OF THE INVENTION

Figure 1:
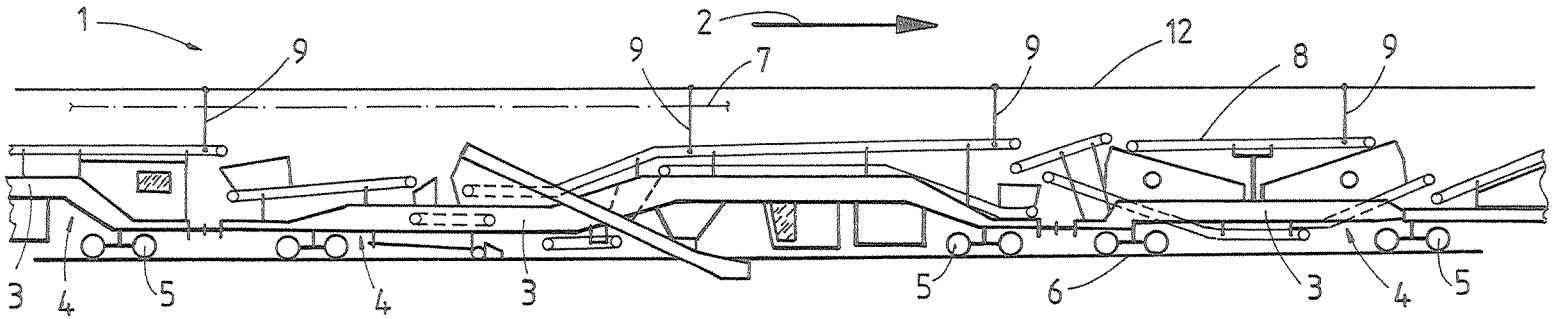
FIG. 1 shows a side view of a track maintenance machine having a safety line extending in the longitudinal direction of the machine, and FIGS. 2 to 4 each show an enlarged detail view of mounts connected to the safety line and to a machine frame.

A track maintenance machine 1 shown in FIG. 1 is composed of several vehicles 4, arranged one following the other in a longitudinal direction 2 of the machine and each having a machine frame 3. Said vehicles 4 are mobile by means of on-track undercarriages 5 on a track 6. The latter has a clearance gauge 7 delimiting the passable or usable space.

Figure 2:
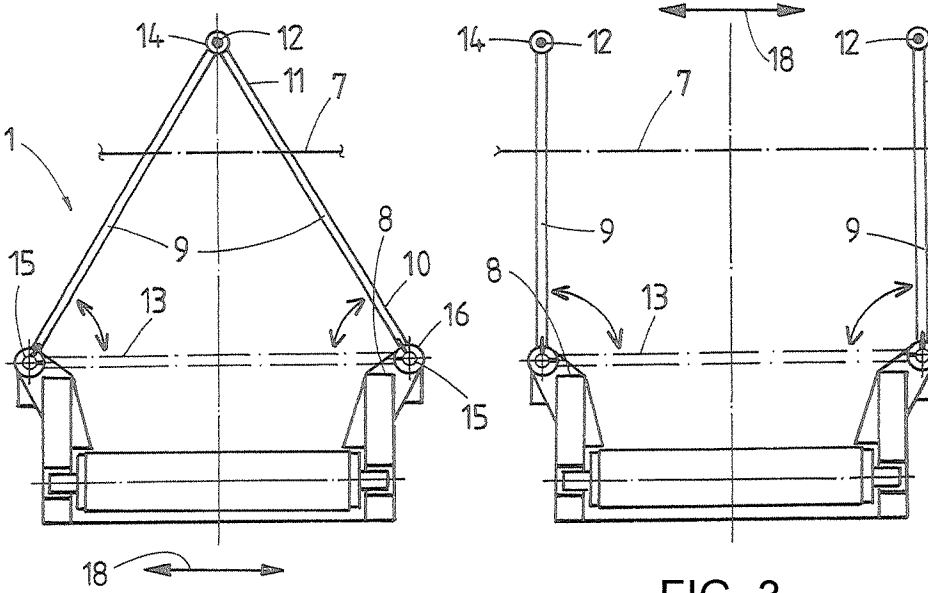
Figure 3:
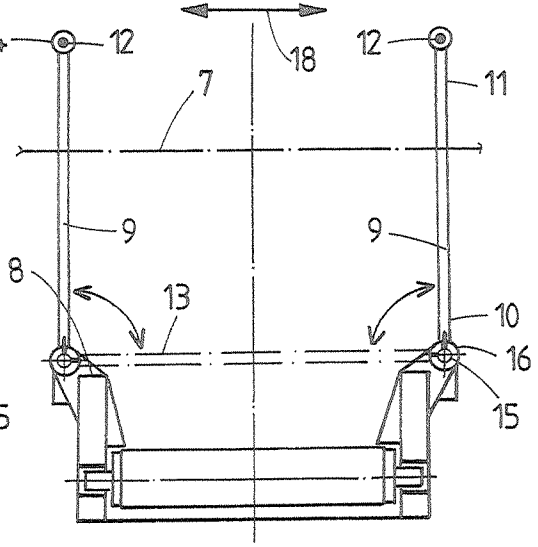
Figure 4:
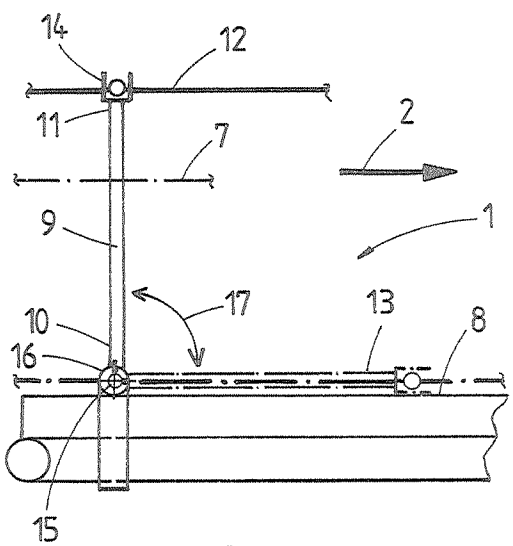

As can be seen in particular also in FIGS. 2 to 4, a plurality of mounts 9, spaced from one another in the longitudinal direction 2 of the machine, is arranged in an upper end region 8—with respect to a vertical—of the track maintenance machine 1.

Each mount 9 has a lower end 10—with respect to the vertical—fastened to the track maintenance machine 1, while an upper end 11—spaced from the lower end 10—of each mount 9 is connected to a safety line extending in the longitudinal direction 2 of the machine.

Each mount 9 is pivotable from a passive position 13, situated within the clearance profile 7 prescribed for the track 6 travelled upon (see dash-and-dot lines), into an active position 14. In the latter, the upper end 11 of each mount 9 as well as the safety line 12 come to lie outside the clearance profile 7 with respect to the vertical.

In the embodiments shown, each mount 9 has a joint 15, situated within the clearance profile 7, for pivoting from the passive position 13 into the active position 14, wherein a joint lock (not further shown) is provided for each position 13, 14.

Each mount 9 may have a pivoting drive 16 for remote-controlled adjustment from the one to the other position 13, 14 (see arrow 17 in FIG. 4).

According to a variant of the invention as visible in FIG. 3, two safety lines 12 are provided, spaced from one another with regard to a transverse direction 18 of the machine and extending parallel to one another, each of which is fastened to mounts 9 spaced from one another in the transverse direction 18 of the machine.

In a further variant, not shown, the mounts 9 can also be designed to be telescopically elongatable in their longitudinal direction in order to reach the active position.

In order to perform service work on track maintenance machines, the safety line 12 extending in the longitudinal direction 2 of the machine or track and connected via the mounts 9 to the machine frame 3 is distanced with regard to a vertical from the machine frame 3 prior to the start of service work. Subsequently, a worker performing the service work has the possibility to latch a safety leash, fixed to the body, into the safety line 12. The worker can then move freely with maximum safety up to the next mount 9 for performing service works. To move further onward, the worker only needs to latch himself into the adjoining line section.

The invention claimed is:

1. A track maintenance machine, comprising:

a longitudinal direction of the track maintenance machine and an upper end region of the track maintenance machine relative to a vertical;

on-track undercarriages;

a machine frame movable on said on-track undercarriages for carrying out track maintenance operations;

a safety line extending in said longitudinal direction; and a plurality of mounts disposed in said upper end region and spaced apart from one another in said longitudinal direction, each of said mounts having a lower end relative to said vertical being fastened to said machine frame and an upper end being spaced apart from said lower end and connected to said safety line;

each of said mounts being pivotable from a passive position, situated within a clearance gauge prescribed for a track being travelled upon, into an active position in which said upper end of each of said mounts as well as said safety line come to lie outside the clearance gauge relative to said vertical.

2. The track maintenance machine according to claim 1, wherein each of said mounts has a joint situated within the clearance profile for pivoting from said passive position into said active position and a joint lock provided for each of said positions.

3. The track maintenance machine according to claim 2, wherein each of said mounts has a pivoting drive for remote-controlled adjustment of said mount from one to another of said positions.

4. The track maintenance machine according to claim 1, wherein said safety line is one of two safety lines being mutually parallel and spaced apart from one another relative to a transverse direction of the track maintenance machine, said mounts being spaced apart from one another in said transverse direction and each of said mounts being fastened to a respective one of said safety lines.

5. The track maintenance machine according to claim 1, wherein each of said mounts is formed of a plurality of parts and is telescopically elongatable.

6. A method for carrying out service work on track maintenance machines, the method comprising the following steps:

prior to a start of the service work, providing a safety line disposed at a distance from a machine frame of the track maintenance machine relative to a vertical and extending in a longitudinal direction of the track maintenance machine or a track;

connecting the safety line to the machine frame by using mounts having upper ends;

subsequently latching a worker performing the service work onto the safety line by using a safety leash connected to the worker to permit free movement of the worker in the longitudinal direction; and pivoting each of the mounts from a passive position, situated within a clearance gauge prescribed for a track being travelled upon, into an active position in which the upper end of each of the mounts as well as the safety line come to lie outside the clearance gauge relative to the vertical.

* * * * *